US010377607B2

(12) United States Patent
Mozsgai

(10) Patent No.: US 10,377,607 B2
(45) Date of Patent: Aug. 13, 2019

(54) ROPE SYSTEMS AND METHODS FOR USE AS A ROUND SLING

(71) Applicant: Samson Rope Technologies, Ferndale, WA (US)

(72) Inventor: Greg Zoltan Mozsgai, Blaine, WA (US)

(73) Assignee: Samson Rope Technologies, Ferndale, MI (US)

( * ) Notice: Subject to any disclaimer, the term of this patent is extended or adjusted under 35 U.S.C. 154(b) by 70 days.

(21) Appl. No.: 15/498,180

(22) Filed: Apr. 26, 2017

(65) Prior Publication Data

US 2017/0313554 A1 Nov. 2, 2017

Related U.S. Application Data

(60) Provisional application No. 62/330,110, filed on Apr. 30, 2016.

(51) Int. Cl.

| | |
|---|---|
| ***B66C 1/12*** | (2006.01) |
| ***D07B 7/16*** | (2006.01) |
| ***B66C 1/18*** | (2006.01) |

(52) U.S. Cl.

CPC ..... *B66C 1/12* (2013.01); *B66C 1/18* (2013.01); *D07B 7/165* (2013.01); *D07B 7/167* (2013.01)

(58) Field of Classification Search

CPC ..... B66C 1/12; D07B 7/165; D07B 7/167
USPC ..... 294/74
See application file for complete search history.

(56) References Cited

U.S. PATENT DOCUMENTS

| | | | |
|---|---|---|---|
| 568,531 | A | 9/1896 | Harthan |
| 1,168,802 | A | 1/1916 | Harrison |
| 1,257,398 | A | 2/1918 | Roach |
| 1,479,865 | A | 1/1924 | Metcalf |
| 1,490,387 | A | 4/1924 | Hansen |
| 1,695,480 | A | 12/1928 | Buoy |
| 1,710,740 | A | 4/1929 | Ljungkull |
| 1,769,945 | A | 7/1930 | Erkert |
| 1,833,587 | A | 11/1931 | Page |

(Continued)

FOREIGN PATENT DOCUMENTS

| | | |
|---|---|---|
| CA | 2019499 A1 | 2/2000 |
| CN | 200910203184 | 6/2009 |

(Continued)

OTHER PUBLICATIONS

European Patent Office, "Extended European Search Report", Application No. 17168853.4, dated Sep. 29, 2017, 8 pages.

(Continued)

*Primary Examiner* — Paul T Chin
(74) *Attorney, Agent, or Firm* — Michael R. Schacht; Schacht Law Office, Inc.

(57) ABSTRACT

A round sling system comprises a bearing structure, a cover, and at least one organizer secured to the cover. The bearing structure is arranged to define a plurality of loop portions and to define at least one bearing structure end portion. The cover defines a cover chamber. The at least one organizer is configured to engage the bearing structure such that the at least one organizer maintains a position of the bearing structure relative to the cover and the at least one organizer maintains a spatial relationship of the loop portions at least within the at least one bearing structure end portion.

14 Claims, 12 Drawing Sheets

(56) References Cited

U.S. PATENT DOCUMENTS 1,839,698 A 1/1932 Novotny
1,850,767 A 3/1932 Page
1,908,686 A 5/1933 Burke
1,931,808 A 10/1933 Hans
2,070,362 A 2/1937 Willy
2,074,956 A 3/1937 Carstarphen
2,080,148 A 5/1937 Naysmith
2,142,642 A 1/1939 Garris
2,245,824 A 6/1941 George
2,299,568 A 10/1942 Dickey
2,338,831 A 1/1944 Whitcomb et al.
2,359,424 A 10/1944 Joy
2,413,642 A 12/1946 Mitchell
2,454,592 A 11/1948 Budzinski
2,480,005 A 8/1949 Ewell
2,482,204 A 9/1949 Peterson
2,840,983 A 7/1958 Keilbach
2,960,365 A 11/1960 Meisen
3,035,476 A 5/1962 Fogden
3,073,209 A 1/1963 Benk et al.
3,181,907 A 5/1965 O'Donnell
3,276,810 A 10/1966 Antell
3,295,303 A 1/1967 Beveridge
3,358,434 A 12/1967 Mccann
3,367,095 A 2/1968 Field
3,371,476 A 3/1968 Costello et al.
3,383,849 A 5/1968 Stirling
3,411,400 A 11/1968 Morieras et al.
3,415,052 A 12/1968 Stanton
3,425,737 A 2/1969 Sutton
RE26,704 E 11/1969 Norton
3,481,134 A 12/1969 Whewell
3,507,949 A 4/1970 Campbell
3,524,690 A 8/1970 Gurney
3,537,742 A 11/1970 Black
3,561,318 A 2/1971 Andriot, Jr.
3,583,749 A 6/1971 Hopkins
3,653,295 A 4/1972 Pintard
3,662,533 A 5/1972 Snellman et al.
3,718,945 A 3/1973 Brindejonc de Treglode
3,729,920 A 5/1973 Sayers et al.
3,762,865 A 10/1973 Weil
3,771,305 A 11/1973 Barnett
3,839,207 A 10/1974 Weil
3,854,767 A 12/1974 Burnett
3,904,458 A 9/1975 Wray
3,906,136 A 9/1975 Weil
3,915,618 A 10/1975 Feucht et al.
3,943,644 A 3/1976 Walz
3,957,923 A 5/1976 Burke
3,968,725 A 7/1976 Holzhauer
3,977,172 A 8/1976 Kerawalla
3,979,545 A 9/1976 Braus et al.
4,022,507 A 5/1977 Marino
4,031,121 A 6/1977 Brown
4,036,101 A 7/1977 Burnett
4,045,072 A 8/1977 Brown
4,050,230 A 9/1977 Senoo et al.
4,056,928 A 11/1977 de Vries
4,099,750 A 7/1978 McGrew
4,114,360 A 9/1978 Emmons
4,116,481 A 9/1978 Raue
4,155,394 A 5/1979 Shepherd et al.
4,159,618 A 7/1979 Sokaris
4,170,921 A 10/1979 Repass
4,173,113 A 11/1979 Snellman et al.
4,184,784 A 1/1980 Killian
4,191,009 A 3/1980 Thomson
4,195,113 A 3/1980 Brook
4,202,164 A 5/1980 Simpson et al.
429,174 A 6/1980 Ogilvy
4,210,089 A 7/1980 Lindahl
4,226,035 A 10/1980 Saito
4,228,641 A 10/1980 O'Neil
4,232,619 A 11/1980 Lindahl
4,232,903 A 11/1980 Welling et al.
4,250,702 A 2/1981 Gundlach
4,257,221 A 3/1981 Feinberg
4,258,608 A 3/1981 Brown
4,286,429 A 9/1981 Lin
4,312,260 A 1/1982 Morieras
4,321,854 A 3/1982 Foote et al.
4,329,794 A 5/1982 Rogers
4,350,380 A 9/1982 Williams
4,375,779 A 3/1983 Fischer
4,403,884 A 9/1983 Barnes
4,412,474 A 11/1983 Hara
4,414,799 A 11/1983 Alexander et al.
4,421,352 A 12/1983 Raue et al.
4,464,812 A 8/1984 Crook et al.
4,500,593 A 2/1985 Weber
4,509,233 A 4/1985 Shaw
4,534,163 A 8/1985 Schuerch
4,534,262 A 8/1985 Swenson
4,563,869 A 1/1986 Stanton
4,606,183 A 8/1986 Riggs
4,619,108 A 10/1986 Hotta
4,635,989 A 1/1987 Tremblay et al.
4,640,179 A 2/1987 Cameron
4,642,854 A 2/1987 Kelly et al.
4,674,801 A 6/1987 DiPaola et al.
4,677,818 A 7/1987 Honda et al.
4,757,719 A * 7/1988 Franke ..... B66C 1/18
340/675
4,762,583 A 8/1988 Kaempen
4,779,411 A 10/1988 Kendall
4,784,918 A 11/1988 Klett et al.
4,850,629 A 7/1989 St. Germain
4,856,837 A 8/1989 Hammersla
4,868,041 A 9/1989 Yamagishi et al.
4,887,422 A 12/1989 Klees et al.
4,947,917 A 8/1990 Noma et al.
4,958,485 A 9/1990 Montgomery et al.
4,974,488 A 12/1990 Spralja
4,978,360 A 12/1990 Devanathan
5,060,466 A 10/1991 Matsuda et al.
5,091,243 A 2/1992 Tolbert et al.
5,141,542 A 8/1992 Fangeat et al.
5,178,923 A 1/1993 Andrieu et al.
5,211,500 A 5/1993 Takaki et al.
D338,171 S 8/1993 Bichi
5,240,769 A 8/1993 Ueda et al.
5,288,552 A 2/1994 Hollenbaugh, Jr. et al.
5,296,292 A 3/1994 Butters
5,327,714 A 7/1994 Stevens et al.
5,333,442 A 8/1994 Berger
5,378,522 A 1/1995 Lagomarsino
5,426,788 A 6/1995 Meltzer
5,429,869 A 7/1995 McGregor et al.
5,441,790 A 8/1995 Ratigan
5,483,911 A 1/1996 Kubli
5,497,608 A 3/1996 Matsumoto et al.
5,501,879 A 3/1996 Murayama
5,506,043 A 4/1996 Lilani
5,525,003 A 6/1996 Williams et al.
5,636,506 A 6/1997 Yngvesson
5,643,516 A 7/1997 Raza et al.
5,651,572 A * 7/1997 St. Germain ..... B66C 1/12
294/74
5,669,214 A 9/1997 Kopanakis
5,699,657 A 12/1997 Paulson
5,711,243 A 1/1998 Dunham
5,718,532 A 2/1998 Mower
5,727,833 A 3/1998 Coe
5,802,839 A 9/1998 Van Hook
5,822,791 A 10/1998 Baris
5,826,421 A 10/1998 Wilcox et al.
5,852,926 A 12/1998 Breedlove
5,873,758 A 2/1999 Mullins
5,904,438 A 5/1999 Vaseghi et al.
5,931,076 A 8/1999 Ryan
5,943,963 A 8/1999 Beals
5,978,638 A 11/1999 Tanaka et al.
6,015,618 A 1/2000 Orima

(56) References Cited

U.S. PATENT DOCUMENTS 6,033,213 A 3/2000 Halvorsen, Jr.
6,045,571 A 4/2000 Hill et al.
6,050,587 A * 4/2000 Panhausen ..... B60D 1/18 280/480
6,085,628 A 7/2000 Street et al.
6,122,847 A 9/2000 Treu et al.
6,146,759 A 11/2000 Land
6,164,053 A 12/2000 Olsen
6,265,039 B1 7/2001 Drinkwater et al.
6,295,799 B1 10/2001 Baranda
6,341,550 B1 1/2002 White
6,365,070 B1 4/2002 Stowell et al.
6,405,519 B1 6/2002 Shaikh et al.
6,410,140 B1 6/2002 Land et al.
6,422,118 B1 7/2002 Edwards
6,422,624 B1 * 7/2002 Kauffman ..... B66C 1/18 294/74
6,484,423 B1 11/2002 Murray
6,524,690 B1 2/2003 Dyksterhouse
6,575,072 B2 6/2003 Pellerin
6,592,987 B1 7/2003 Sakamoto et al.
6,601,378 B1 8/2003 Fritsch et al.
6,704,535 B2 3/2004 Kobayashi et al.
6,876,798 B2 4/2005 Triplett et al.
6,881,793 B2 4/2005 Sheldon et al.
6,916,533 B2 7/2005 Simmelink et al.
6,945,153 B2 9/2005 Knudsen et al.
7,051,664 B2 5/2006 Robichaud et al.
7,093,416 B2 8/2006 Johnson et al.
7,107,749 B2 9/2006 Wetzels et al.
7,127,878 B1 10/2006 Wilke et al.
7,134,267 B1 11/2006 Gilmore et al.
7,137,617 B2 11/2006 Sjostedt
7,165,485 B2 1/2007 Smeets et al.
7,168,231 B1 1/2007 Chou et al.
7,172,878 B1 2/2007 Nowak et al.
7,182,900 B2 2/2007 Schwamborn et al.
7,240,475 B2 7/2007 Smeets et al.
7,296,394 B2 11/2007 Clough et al.
7,331,269 B2 2/2008 He et al.
7,367,176 B1 5/2008 Gilmore et al.
7,389,973 B1 6/2008 Chou et al.
7,415,783 B2 8/2008 Huffman et al.
7,437,869 B1 10/2008 Chou et al.
7,472,502 B2 1/2009 Gregory et al.
7,475,926 B2 1/2009 Summars
D592,537 S 5/2009 Darnell
7,568,419 B2 8/2009 Bosman
7,637,549 B2 12/2009 Hess
7,681,934 B2 3/2010 Harada et al.
7,735,308 B1 6/2010 Gilmore et al.
7,739,863 B1 6/2010 Chou et al.
7,743,596 B1 6/2010 Chou et al.
7,784,258 B2 8/2010 Hess
7,823,496 B2 11/2010 Bosman et al.
7,849,666 B2 12/2010 Kirth et al.
7,908,955 B1 3/2011 Chou et al.
7,918,079 B2 4/2011 Bloch
8,109,071 B2 2/2012 Gilmore
8,109,072 B2 2/2012 Chou et al.
8,171,713 B2 5/2012 Gilmore et al.
8,171,714 B2 5/2012 Wienke et al.
8,250,845 B2 8/2012 Kimura et al.
8,302,374 B2 11/2012 Marissen et al.
8,341,930 B1 1/2013 Chou et al.
8,381,504 B2 2/2013 Pettersen
8,387,505 B2 3/2013 Chou et al.
8,418,434 B1 4/2013 Carruth et al.
8,511,053 B2 8/2013 Chou et al.
8,689,534 B1 4/2014 Chou
8,707,666 B2 4/2014 Crozier et al.
8,707,668 B2 4/2014 Gilmore et al.
8,727,406 B2 * 5/2014 Dohse ..... B66C 1/12 294/74
9,003,757 B2 * 4/2015 Mozsgai ..... B66C 1/12 57/201
9,261,167 B2 2/2016 Chou
2003/0200740 A1 10/2003 Tao et al.
2003/0226347 A1 12/2003 Smith et al.
2004/0025486 A1 2/2004 Takiue
2004/0069132 A1 4/2004 Knudsen et al.
2005/0062303 A1 3/2005 Hess
2005/0172605 A1 8/2005 Vancompernolle et al.
2005/0279074 A1 12/2005 Johnson et al.
2006/0048494 A1 3/2006 Wetzels et al.
2006/0048497 A1 3/2006 Bloch
2006/0179619 A1 8/2006 Pearce et al.
2006/0213175 A1 9/2006 Smith et al.
2007/0063522 A1 3/2007 Byrne
2007/0079695 A1 4/2007 Bucher et al.
2007/0137163 A1 6/2007 Hess
2007/0144134 A1 6/2007 Kajihara
2007/0169457 A1 7/2007 Kijesky
2007/0266693 A1 11/2007 Kato et al.
2008/0299855 A1 12/2008 Morihashi
2009/0047475 A1 2/2009 Jeon
2009/0282801 A1 11/2009 Gilmore
2010/0123324 A1 * 5/2010 Shoup ..... B66C 1/20 294/74
2011/0067275 A1 3/2011 Doan
2011/0083415 A1 4/2011 Marissen et al.
2011/0192132 A1 8/2011 Kimura et al.
2011/0197564 A1 8/2011 Lachariades et al.
2011/0269360 A1 11/2011 Mueller
2012/0121843 A1 5/2012 Lebel et al.
2012/0198808 A1 8/2012 Bosman et al.
2012/0244333 A1 9/2012 Aksay et al.
2012/0260620 A1 10/2012 Kim et al.
2012/0266583 A1 10/2012 Crozier et al.
2012/0297746 A1 11/2012 Chou et al.
2013/0174719 A1 7/2013 Chou et al.
2014/0000233 A1 1/2014 Chou et al.
2014/0070557 A1 3/2014 Mozsgai et al.
2015/0267347 A1 9/2015 Farmer
2016/0046465 A1 * 2/2016 Babinchak ..... B60P 7/0869 294/74
2016/0090276 A1 * 3/2016 Conrad ..... B66C 1/122 294/74

FOREIGN PATENT DOCUMENTS

CN 2009102031840 6/2009
DE 1600263 A1 5/1970
DE 7315621 U 10/1973
EP 0374067 B1 8/1994
EP 0785163 B1 12/2001
EP 1397304 A1 3/2004
EP 2028308 A2 2/2009
EP 2130969 A2 12/2009
EP 1659209 B1 5/2011
EP 3239090 11/2017
FR 2197392 3/1974
GB 312464 A 5/1929
JP 469565 4/1971
JP 4625320 B2 9/1971
JP S57161116 A 10/1982
JP 1260080 10/1989
JP 2242987 9/1990
JP 3033285 B2 2/1991
JP 2000212884 A 8/2000
JP 2004126505 A 4/2004
JP 2009293181 A 12/2009
JP 3158927 B2 4/2010
KR 1019900010144 7/1990
KR 1020090044381 5/2009
RU 1791325 1/1993
RU 2100674 C1 12/1997
RU 2295144 C2 3/2007
RU 2425187 C2 7/2011
SU 436115 7/1974
SU 618061 7/1978
SU 1647183 5/1991

(56) References Cited

FOREIGN PATENT DOCUMENTS

| | | | |
|---|---|---|---|
| SU | 1723004 | | 3/1992 |
| WO | 03102295 | | 12/2003 |
| WO | 2004021771 | A2 | 3/2004 |
| WO | 2004067434 | A1 | 8/2004 |
| WO | 2005075559 | A1 | 8/2005 |
| WO | 2008144046 | A1 | 11/2008 |
| WO | 2008144047 | A1 | 11/2008 |
| WO | 2008144048 | A1 | 11/2008 |
| WO | 2013134033 | A1 | 9/2013 |
| ZA | 2009008815 | | 8/2010 |

OTHER PUBLICATIONS

ACMA, Pultrusion Industry Council, http://www.acmanet.org/pic/products/description.htm, "products & process: process description", 2001, 2 pages.
Bridon, "Fibre Rope Catalogue: M Steel Winchline", 2011, p. 17.
Bridon, "Fibre Rope Catalogue: TQ12", 2011, p. 18.
Entec, http://www.entec.com/pultrusion.shtml, "Pultrusion Equipment", Nov. 2006, 4 pages.
H. A. McKenna et al., "Handbook of fibre rope technology", 2004, pp. 88, 89, 100, Woodhead Publishing Limited, England, CRC Press LLC, USA.
Herzog Braiding Machines, "Rope Braiding Machines Seng 140 Series", 2 pages.
Herzog Braiding Machines, "Rope Braiding Machines Seng 140 Series", predates 2004, 2 pages.
Herzog Braiding Machines, "Rope Braiding Machines Seng 160 Series", 2 pages.
Herzog Braiding Machines, "Rope Braiding Machines Seng 160 Series", predates 2004, 2 pages.
International Searching Authority, ISR PCT/US2013/059081, dated Dec. 26, 2013, 7 pages.
International Searching Authority, ISR PCT/US2014020529, dated Jun. 10, 2014, 7 pages.
International Searching Authority, ISR PCT/US2014023749, dated Jun. 26, 2014, 7 pages.
International Searching Authority, ISR PCT/US2014026726, dated Jun. 19, 2014, 7 pages.
Kaneya Seiko Co., Ltd., "Super Triple Cross Rope", 2007, 3 pages.
Pasternak, Shelton, & Gilmore, "Synthetic 'Mud Ropes' for Offshore Mooring Applications—Field History and Testing Data", Sep. 2011, 8 pages.
Pultrusion Industry Council, http://www.acmanet.org/pic/products/description.htm, "products & process: process description", 2001, 2 pages.
Samson Rope Technologies, "Whoopie Sling Amsteel/Amsteel-Blue" Splicing Instructions, 2012, 2 pages.
Samson Rope Technologies, Inc., "Dynalene Installation Instructions for Covering 12-Strand Rope", 2005, 12 pages.
Samson Rope Technologies, Inc., "Innovative Chafe Protection Solutions for High Performance Ropes", 2006, 4 pages.
Samson Rope Technologies, Inc., "M-8 Offshore Rope", Mar. 2008, 1 page.
Samson Rope Technologies, Inc., "Offshore Product and Technical Guide", Jul. 2011, 8 pages.
Samson Rope Technologies, Inc., "Samson Deep Six Performs Beyond Expectation", Sep. 10, 2008, 2 pages.
Samson Rope Technologies, Inc., "Samson Offshore Expansion Celebrated", Feb. 18, 2009, 2 pages.
Samson Rope Technologies, Inc., www.samsonrope.com/Pages/Product.aspx?ProductID=825, "Tenex-Tec", 2012, 1 page.
Tencom Ltd., http://www.tencom.com/02/pultrusion.htm, "Pultrusion Process", 2006, 2 pages.
Timberland Equipment Limited, "Gatortail Rope Synthetic Pulling Rope", 2010, 5 pages.
US District Court, *Samson Rope Technologies, Inc.* v. *Yale Cordage, Inc.* Case 2:11-cv-00328, Document 1, Complaint (2), DI 001-2011-02-24, 5 pages.
US District Court, *Samson Rope Technologies, Inc.* v. *Yale Cordage, Inc.* Case 2:11-cv-00328-JLR, Document 12, Answer, DI 012-2011-05-10, 6 pages.
US District Court, *Samson Rope Technologies, Inc.* v. *Yale Cordage, Inc.* Case 2:11-cv-00328-JLR, Document 5, Notice to PTO, DI 005-2011-02-25, 1 page.
Wire Rope Technical Board, "Mechanical Splice (Flemish eye)," Wire Rope Sling Users Manual, Third Edition, 2007, p. 12, WRBT Publications, USA.

* cited by examiner

ROPE SYSTEMS AND METHODS FOR USE AS A ROUND SLING

RELATED APPLICATIONS

This application, U.S. patent application Ser. No. 15/498,180 filed Apr. 26, 2017, claims benefit of U.S. Provisional Application Ser. No. 62/330,110 filed Apr. 30, 2016, now expired, the contents of which are incorporated herein by reference.

TECHNICAL FIELD

The present invention relates to rope systems and methods and, more specifically, to rope systems and methods configured to be used as a round sling.

BACKGROUND

A lifting sling is a structure, typically flexible, that allows a connection to be made between first and second attachment points to allow an item to be displaced or, more typically, lifted. For example, a crane may be connected to a load using a sling to allow the crane to lift the load. In this case, the first attachment point may be a hook on the end of the crane, and the second attachment point may be a hook formed by a cargo net or the like that secures the load for lifting.

Slings typically comprise at least an elongate, flexible body having end fittings connected to or formed at each end. The elongate body may be made of, as examples, fabric webbing, wire rope, chain, steel wire mesh, and/or rope round slings. The present invention is of particular significance when embodied as a rope round sling.

A rope round sling typically comprises a load bearing structure comprising load bearing material. The load bearing material typically takes the form of natural or synthetic fibers. The fibers are typically combined to form yarns, and the yarns are typically combined to form strands and/or other sub-components. The load bearing structure may thus take the form of a conventional rope structure spliced together or otherwise formed in the shape of an endless loop.

The load bearing structure is typically covered by a jacket to protect the load bearing structure from abrasion and/or potentially deleterious effects of the elements. The jacket may take the form of a fabric panel structure that is wrapped around the entire endless loop formed by the load bearing structure and secured in place. Alternatively, the jacket may take the form of a cylindrical fabric tube adapted to cover a central portion of the endless loop such that opposing portions of the endless loop form eyes that extend out of each end of the cylindrical fabric tube.

A rope round sling thus may be configured, with or without a jacket, to form first and second eyes adapted to be connected between the first and second attachment points as generally described above. To use a rope round sling in the context of a crane as described above, the crane hook will be passed through a first eye formed by a first portion of the load bearing structure and the load hook would be passed through a second eye formed by a second portion of the load bearing structure opposing the first portion. When the crane hook is raised, the load bearing structure will be placed in tension such that the load is raised with the crane hook.

The need exists for improved rope round slings that are capable of lifting increased loads for a given weight per length unit of the load bearing material.

SUMMARY

The present invention may be embodied as a round sling system comprising a bearing structure, a cover, and at least one organizer secured to the cover. The bearing structure is arranged to define a plurality of loop portions and at least one bearing structure end portion. The cover defines a cover chamber. The at least one organizer is configured to engage the bearing structure such that the at least one organizer maintains a position of the bearing structure relative to the cover and the at least one organizer maintains a spatial relationship of the loop portions at least within the at least one bearing structure end portion.

The present invention may also be embodied as a method of forming a round sling comprising the following steps. A bearing structure is arrange to define a plurality of loop portions. At least one organizer is secured to the cover. The at least one organizer is arranged to engage the bearing structure such that the at least one organizer maintains a position of at least a portion of the bearing structure relative to the cover. The cover is arranged to define a cover chamber such that the bearing structure is within the cover chamber and the at least one organizer maintains a spatial relationship of the loop portions at least within at least one bearing structure end portion defined by the bearing structure.

The present invention may also be embodied as a round sling system adapted to engage first and second structural members comprising a bearing structure, a cover, a securing system, first and second pairs of end organizers, and at least one intermediate organizer. The bearing structure is arranged to define a plurality of loop portions, first and second bearing structure end portions, and first and second bearing structure side portions. The cover comprises first and second cover end edge portions and first and second cover side edge portions. The securing system configures the cover to define a cover chamber. The first and second pairs of end organizers and the at least one intermediate organizer are secured to the cover. The first pair of end organizers are located on the cover to engage the bearing structure adjacent to the first bearing structure end portion. The second pair of end organizers are located on the cover to engage the bearing structure adjacent to the second bearing structure end portion. The at least one intermediate organizer engages the bearing structure within at least one of the first and second bearing structure side portions. The first and second pairs of end organizers maintain a spatial relationship of the loop portions within the first and second bearing structure end portions.

DETAILED DESCRIPTION

Figure 1:
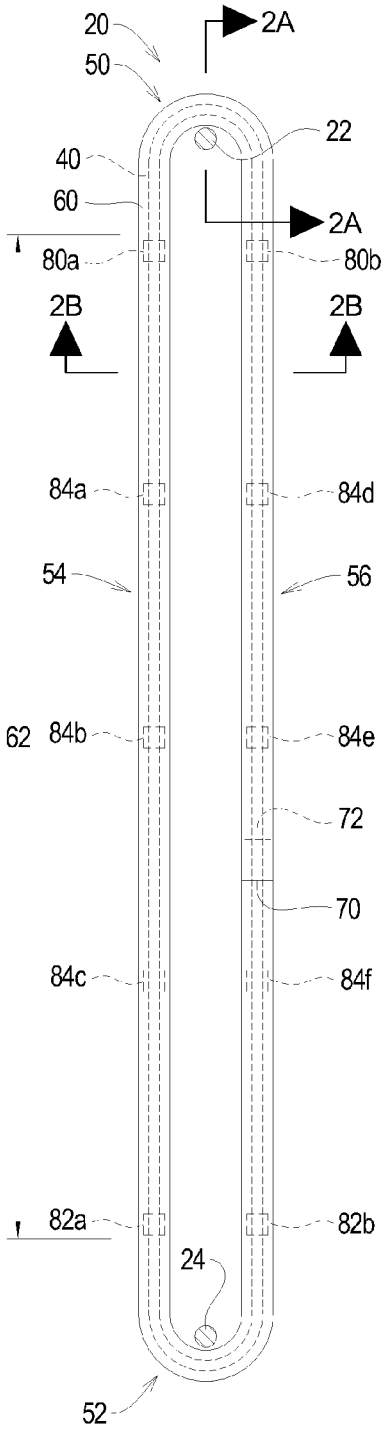
FIG. 1 is a side elevation view of a first example round sling system of the present invention.

A round sling system of the present invention may take a number of different forms, and a number of examples of round sling systems of the present invention and components thereof will be discussed separately below.

I. First Example Round Sling System

Referring initially to FIGS. 1, 2A, 2B, 3A, 4A, and 4B of the drawing, depicted therein is a first example round sling system 20 constructed in accordance with, and embodying, the principles of the present invention. The first example round sling system 20 is adapted to extend between a first structural member 22 and a second structural member 24 such that, for example, lifting loads applied to the first structural member 22 are transferred through the first example round sling system 20 to the second structural member 24. The term "transfer load" will be used to describe the loads transferred by the first example round sling system 20 between the first and second structural members 22 and 24. The first and second structural members 22 and 24 do not form a part of the present invention and thus will be described herein only to that extent helpful to a complete understanding of the construction and use of the first example round sling system 20.

The first example round sling system 20 comprises a bearing structure 30 and a cover assembly 32.

The example bearing structure 30 comprises one or more lengths of rope configured to bear the anticipated transfer loads applied to the first example round sling system 20. As shown, the example bearing structure 30 comprises a single piece of rope arranged in one or more loops 40 to define a plurality of bearing positions 42. The rope forming the example bearing structure 30 is configured to define six loops 40*a*, 40*b*, 40*c*, 40*d*, 40*e*, and 40*f* arranged in six bearing positions 42*a*, 42*b*, 42*c*, 42*d*, 42*e*, and 42*f*. During use of the first example rope sling 20, the bearing structure 30 defines a first end portion 50, a second end portion 52, a first side portion 54, and a second side portion 56 of the first example rope sling 20 as will be described in further detail below.

The example cover assembly 32 comprises a cover member 60, an organizer system 62, and a closure system 64.

The example cover member 60 is a flat sheet of flexible material such as fabric defining a first end edge 70, a second end edge 72, a first side edge 74, and a second side edge 76. The example cover member 60 is capable of being folded or wrapped into a toroidal shape by overlapping the first and second end edges 70 and 72 and the first and second side edges 74 and 76. When folded with the end edges 70 and 72 overlapped and the side edges 74 and 76 overlapped, the cover member 60 defines a cover chamber 78. The example cover chamber 78 is also substantially toroidal. In use, the substantially toroidal shape of the cover chamber 278 is typically elongated as shown in FIG. 1.

The example organizer system 62 comprises at least one first end organizer 80, at least one second end organizer 82, and, optionally, one or more intermediate organizers 84. The example organizer system 62 comprises a first first end organizer 80*a*, a second first end organizer 80*b*, a first second end organizer 82*a*, and a second second end organizer 82*b*. The example organizer system 62 further comprises first, second, third, fourth, fifth, and sixth intermediate organizers 84*a*, 84*b*, 84*c*, 84*d*, 84*e*, and 84*f*.

The example closure system 64 comprises a first edge connector 90 and a second edge connector 92.

When the first example round sling system 20 is formed, the bearing structure 30 is arranged within the cover chamber 78, and the bearing structure 30 and the cover assembly 32 are arranged in an elongate loop as shown in FIG. 1. The elongate loop so formed defines the first and second end portions 50 and 52 and the first and second side portions 54 and 56 of the example bearing structure 30 and thus of the first example round sling system 20.

The first end organizers 80 are secured to the cover member 60 such that the first end organizers 80 are adjacent to the first end 50, while the second end organizers 82 are secured to the cover member 60 such that the second end organizers 80 are adjacent to the second end 52. The intermediate organizers 84 are spaced between the first and second end portions 50 and 52 and are secured to the first and second side portions 54 and 56. In the first example round sling system 20, the first and second first end organizers 80*a* and 80*b* are arranged at each end of the first end portion 50, while the first and second second end organizers 82*a* and 82*b* are arranged at each end of the second end portion 52. Further, in the first example round sling system 20, the first, second, and third intermediate organizers 84*a*, 84*b*, and 84*c* are arranged at evenly spaced locations between the first first end organizer 80*a* and the first second end organizer 82*a* along the first side portion 54. Similarly, the fourth, fifth, and sixth intermediate organizers 84*d*, 84*e*, and 84*f* are arranged at evenly spaced locations between the second first end organizer 80*b* and the second second end organizer 82*b* along the second side portion 56.

The organizers 80, 82, and 84 are configured to hold the loops defined by the rope forming the bearing structure 20 in the appropriate bearing positions 42 relative to the cover assembly 32. In particular, as perhaps best shown in FIGS. 1, 2B, 3A, 4A, and 4B, the example bearing positions 42 are arranged in a grouping such that the longitudinal axes defining the loop portions 40 of the bearing structure 20 is substantially parallel to and spaced from each other along an organizer axis A at each of the bearing positions 42.

Figure 2A:
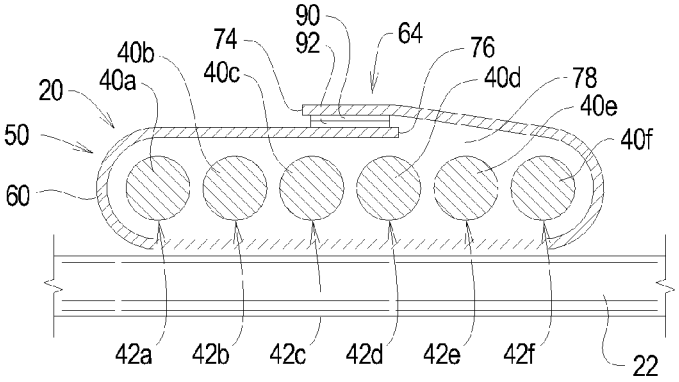
FIG. 2A is a section view taken along lines 2A-2A in FIG. 1.
Figure 2B:
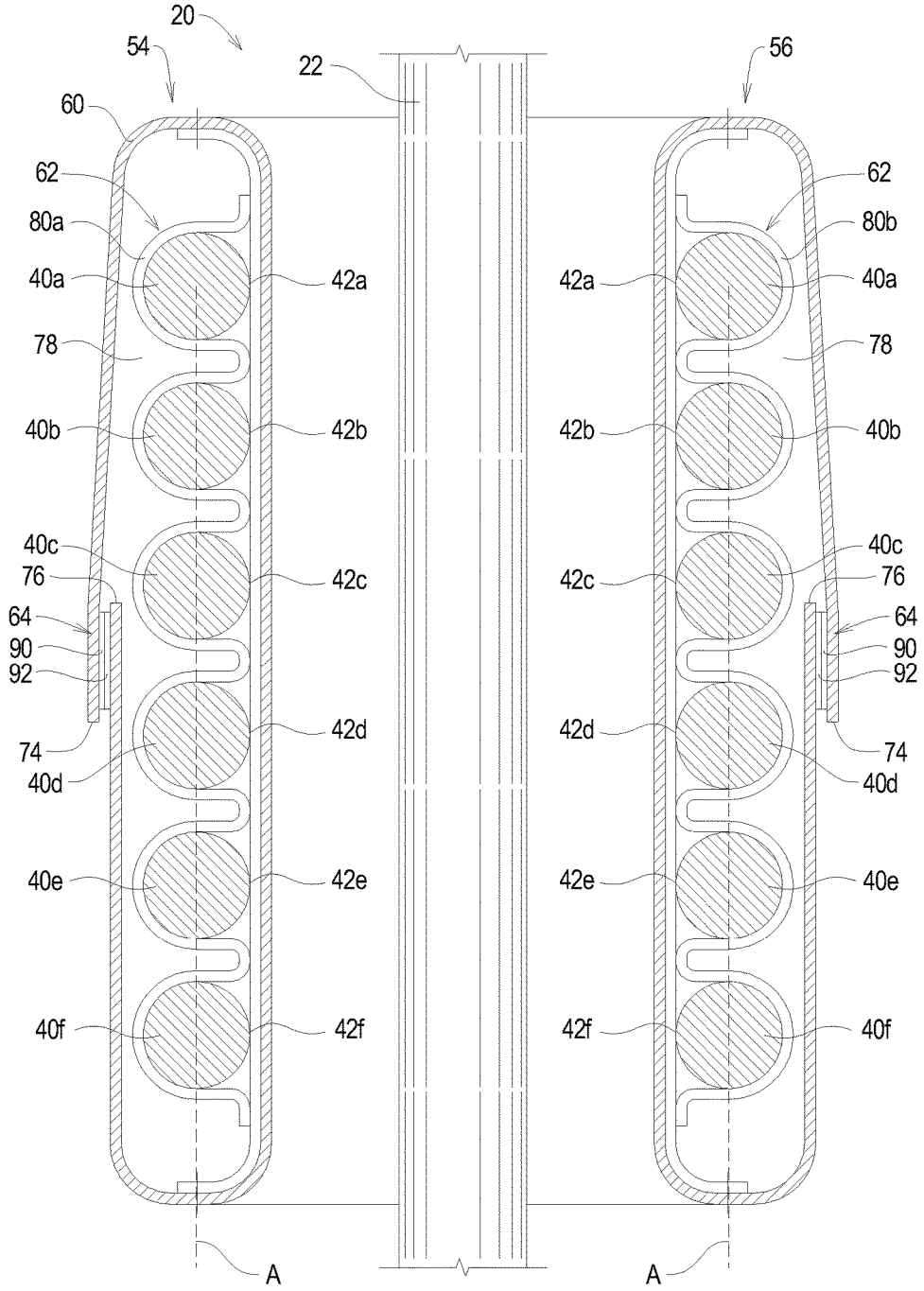
FIG. 2B is a section view taken along lines 2B-2B in FIG. 1.
Figure 4A:
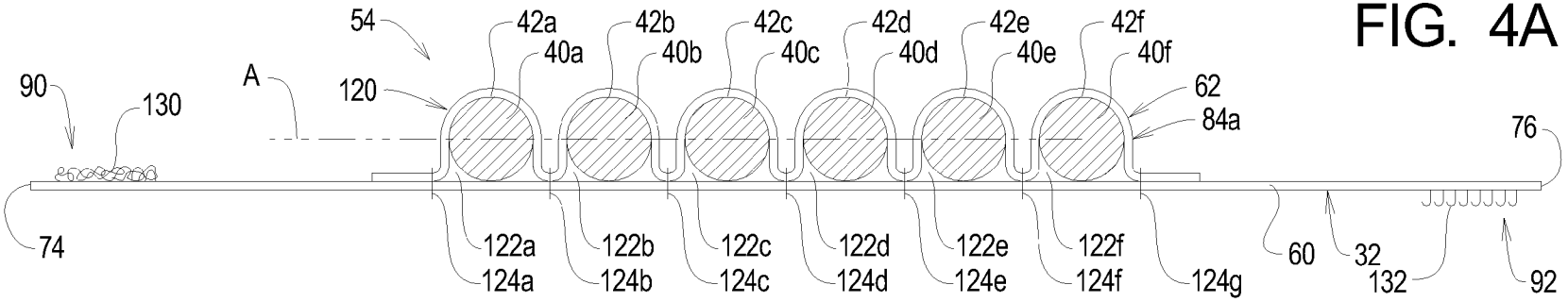
FIGS. 4A and 4B are section views taken along lines 4A-4A and 4B-4B, respectively, in FIG. 3A depicting a first example organizer used as part of the first example round sling system depicted in FIG. 1.
Figure 4B:
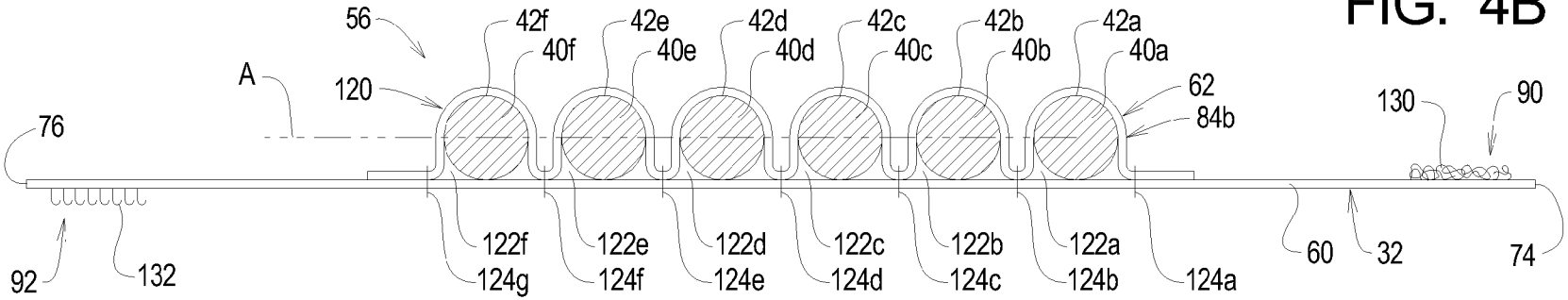

The organizer axes A are depicted as linear FIGS. 2B, 4A, and 4B, but it should be understood that one or more of the organizers 80, 82, and/or 84 may be made of flexible material, in which case the organizer axes A defined thereby can and likely will be curved to define one or more localized points of inflexion along the organizer axis A during normal operation of the first example round sling system 20. However, as will be explained in further detail below, the organizers 80, 82, and 84, and the cover member 60 to which the organizers 80, 82, and 84 are attached, should have sufficient rigidity to prevent the bearing structure 30 from deforming such that the bearing positions 42 do not completely overlap during normal use of first example round sling system 20.

The example closure system 64 secures the first side edge 74 to the second side edge 76 to hold the cover member 60 in a closed configuration to form the cover chamber 78. The example first and second edge connectors 90 and 92 extend along the entire lengths of the side edges 74 and 76, but alternative connector systems may be arranged only at spaced locations along the side edges 74 and 76 as will be described below. A similar connector (not shown) may be arranged to join the first and second end edges 70 and 72, but simply providing sufficient overlap between the first and second end edges 70 and 72 may be effective at holding the cover member 60 in its closed configuration to define the cover chamber 78.

In use, the cover member 60 is held in its closed configuration with the bearing structure 30 within the cover chamber 78. The organizers 80, 82, and 84 are arranged to maintain the bearing structure 30 in a desired relationship with the cover assembly member 60 and also such that the individual loop portions 40 are held within the bearing positions 42. In particular, the first end organizers 80*a* and 80*b* are close enough to each other and the second end organizers 82*a* and 82*b* are close enough to each other to ensure that longitudinal axes of the loop portions 40 are substantially aligned at the first and second end portions 50 and 52 for desired engagement with the structural members 22 and 24, respectively. If, for example, the first structural member 22 is defined by a linear bar, the organizer axes A of the first and second first organizers 80*a* and 80*b* would be substantially linear to ensure that each of the loop portions 40 bears on the linear bar without overlapping another loop portion 40 (see, e.g., 2A). However, if the first structural member 22 is defined by a curved member (e.g., a hook), the organizer axes A of the first and second first organizers 80*a* and 80*b* would be sufficiently curved to ensure that each of the loop portions 40 bears on the curved member but without overlapping another loop portion 40.

With the foregoing basic understanding of the first example round sling system 20 in mind, the details of that first example round sling system 20 will now be described.

Referring now to FIGS. 4A and 4B, of the drawing, the example organizers 84*a* and 84*b* will be described. The example organizers 80, 82, and 84 all are or may be the same, so the description of the organizers 84*a* and 84*b* applies to the other end and intermediate organizers 80, 82, and 84. The example organizers 84*a* and 84*b* each comprises an organizer member 120 secured to the cover member 60 to define organizer openings 122. The example organizer members 120 are sewn to the cover member 60 by threads 124. Alternative securing systems and methods such as snap fasteners, adhesives, hook and loop fasteners, or the like may be used to secure the organizer member 120 to the cover member 60.

The example organizer system 62 employs seven threads 124*a*, 124*b*, 124*c*, 124*d*, 124*e*, 124*f*, and 124*g* to define six of the organizer openings 122*a*, 122*b*, 122*c*, 122*d*, 122*e*, and 122*f*. The six organizer openings 122*a*, 122*b*, 122*c*, 122*d*, 122*e*, and 122*f* correspond to the six example bearing positions 42*a*, 42*b*, 42*c*, 42*d*, 42*e*, and 42*f*, respectively. And the six loop portions 40*a*, 40*b*, 40*c*, 40*d*, 40*e*, and 40*f* are partly arranged within the six organizer openings 122*a*, 122*b*, 122*c*, 122*d*, 122*e*, and 122*f*, respectively.

FIGS. 2A, 2B, 3A, 4A, and 4B illustrate that the example first edge connector 90 is formed by a loop fastener 130 and the example second edge connector 92 is formed by a hook fastener 132. The hook fastener 132 engages loop fastener 130 to secure the first side edge 74 to the second side edge 76 along substantially the entire length of the first and second side edges 74 and 76. Other longitudinal fasteners such as zippers or the like may be used in place of the hook and loop fastener of the example closure system 64.

Figure 3A:
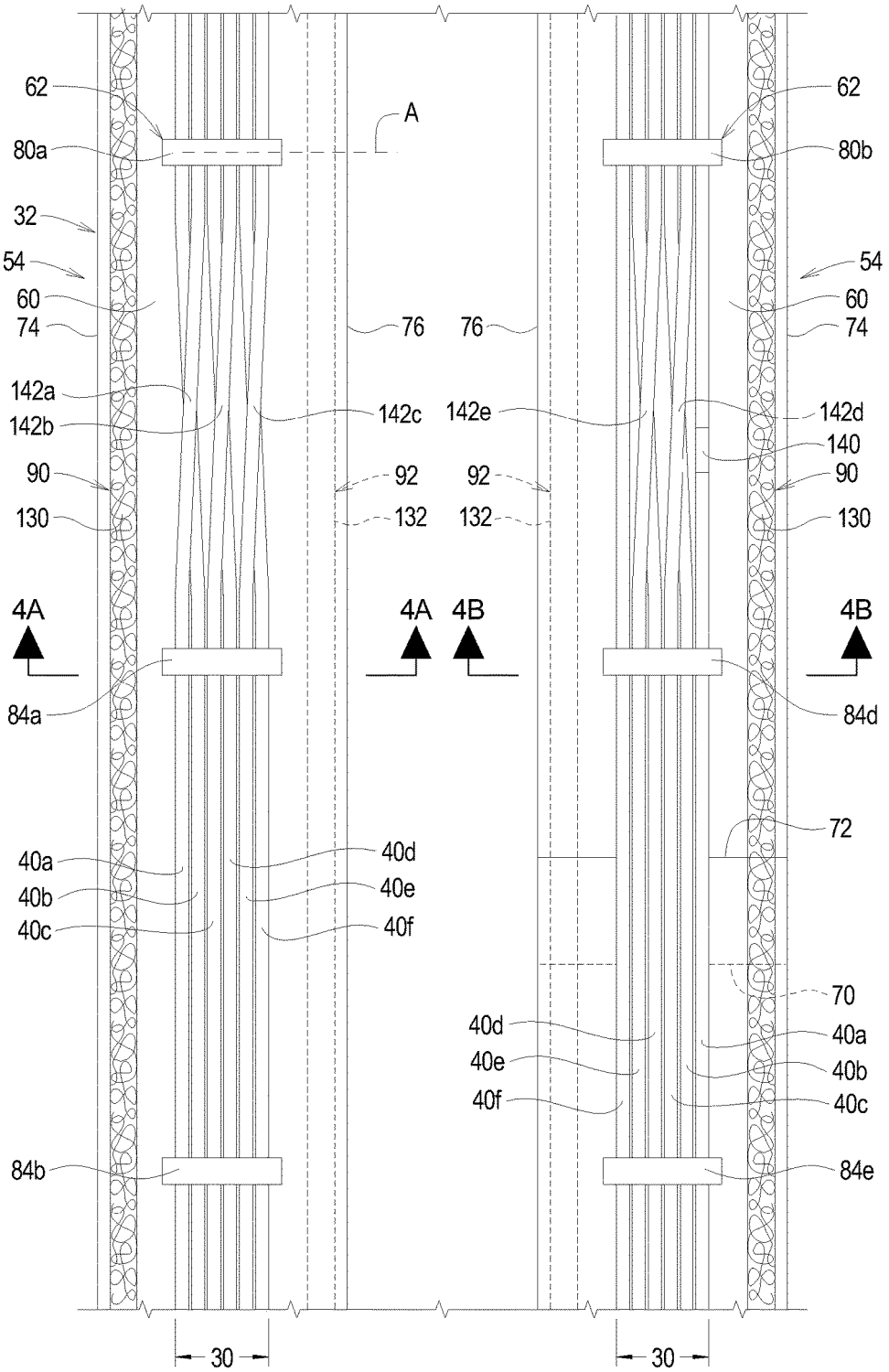
FIG. 3A is a somewhat schematic plan view of a portion of a first example cover member and a first example rope structure used as part of the first example round sling system depicted in FIG. 1.

FIG. 3A further illustrates that the example bearing structure 30 is a single length of rope defining a splice region 140. The rope forming the example bearing structure 30 is arranged relative to the cover member 60 such that the example splice region 140 lies in one of the side portions 54 and 56 (in this case the second side portion 56) of the first example round sling system 20 rather than one of the end portions 50 or 52.

In addition, FIG. 3A illustrates that the loop portions 40 formed by the example bearing structure 30 cross at one or more crossing points 142. In particular, the example loop portions 40*a*, 40*b*, 40*c*, 40*d*, 40*e*, and 40*f* cross at first, second, third, fourth, and fifth crossing points 142*a*, 142*b*, 142*c*, 142*d*, and 142*e*. In particular, the first, second, and third crossing points 142*a*, 142*b*, and 142*c* are within the first side portion 54, while the fourth and fifth crossing points 142*d* and 142*e* are within the second side portion 56. Further, the first, second, and third crossing points 142*a*, 142*b*, and 142*c* are between the first first end organizer 80*a* and the first intermediate organizer 84*a*, while the fourth and fifth crossing points 142*d* and 142*e* are between the second first organizer 80*b* and the fourth intermediate organizer 84*d*. This arrangement further allows the loop portion 40*a* containing the splice region 140 to be straight and not overlap another loop portion 40 and eliminates the crossing of one loop portion 40 over multiple other loop portions 40. And as generally described above, all crossing of any two (or possibly more) loop portions 40 should be within one of the side portions 54 and 56 and not within one of the end portions 50 or 52.

Figure 3B:
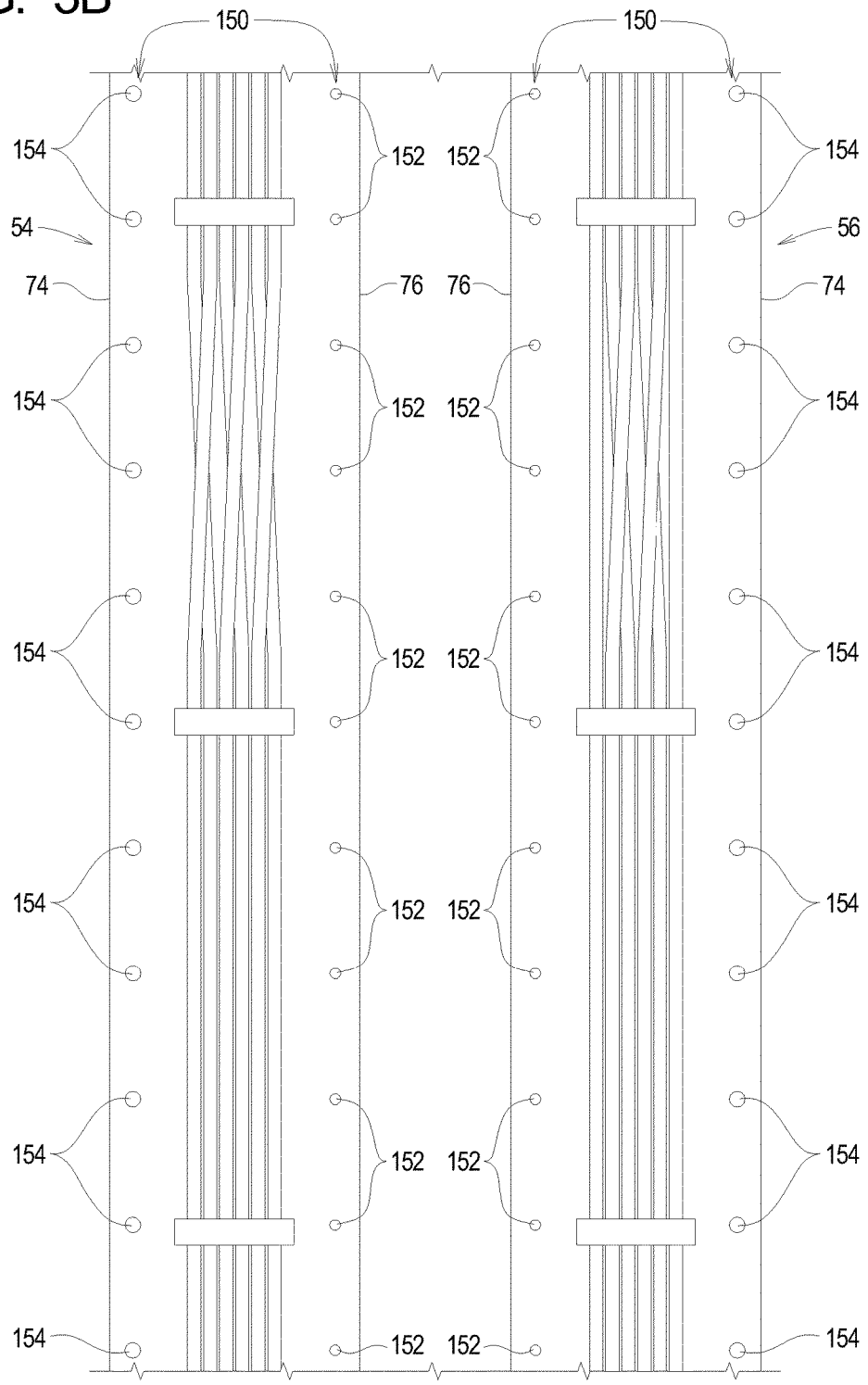
FIG. 3B is a somewhat schematic plan view of a portion of a second example cover member and the first example rope structure that may be used as part of the first example round sling system depicted in FIG. 1.

FIG. 3B illustrates a second example closure system 150 comprising a plurality of snap fasteners arranged at spaced locations along the first and second side edges 74 and 76. In particular, the example closure system 150 comprises a plurality of snap buttons 152 each arranged to engage one of a plurality of snap receivers 154. The mechanically engaging the snap buttons 152 with the snap receivers 154, the first and second side edges 74 and 76 are effectively secured together to form the cover chamber 78.

Figure 3C:
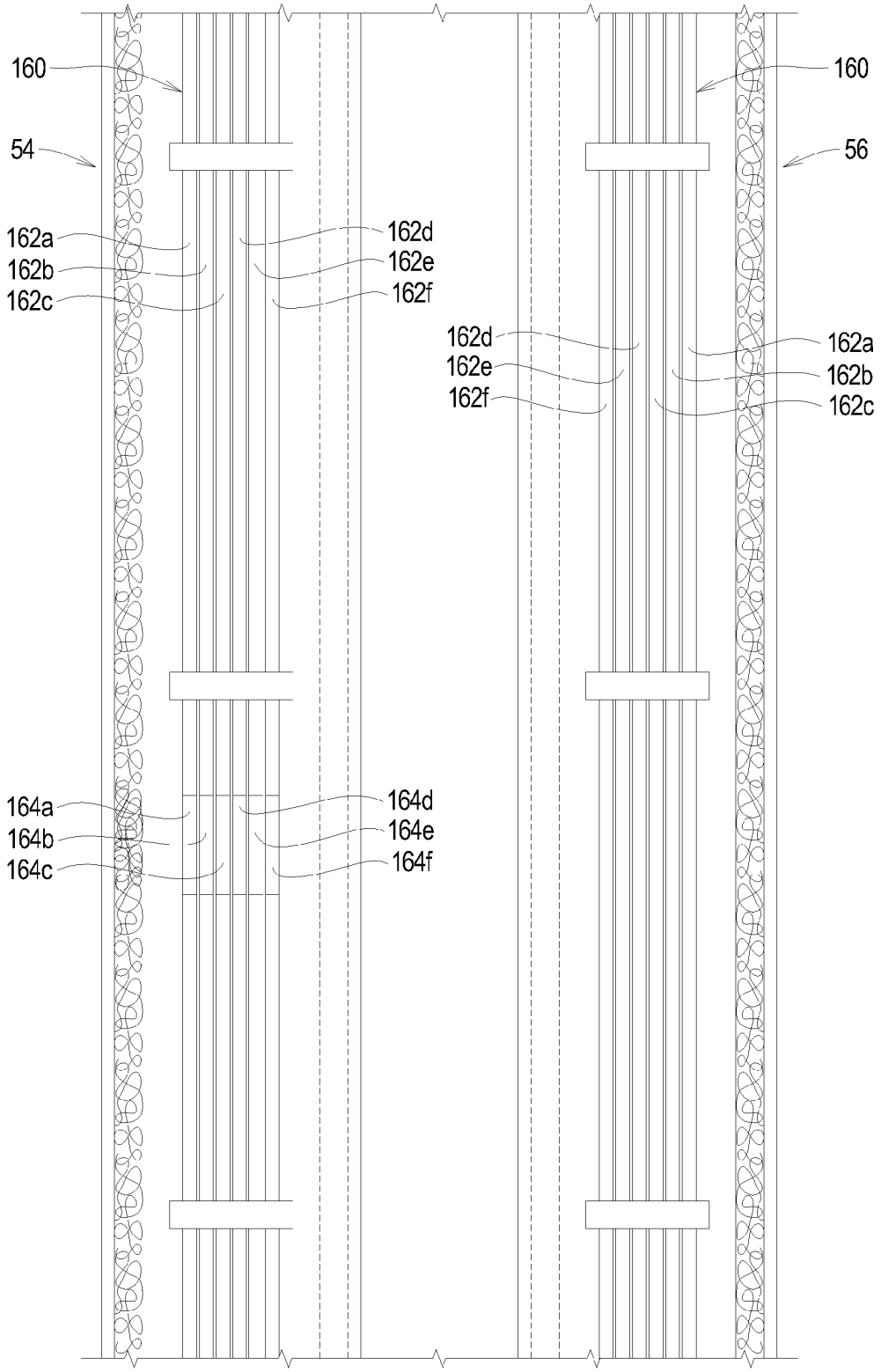
FIG. 3C is a somewhat schematic plan view of a portion of the first example cover member and a second example rope structure that may be used as part of the first example round sling system depicted in FIG. 1.

FIG. 3C illustrates a second example bearing structure 160 that may be used in place of the example bearing structure 30 formed by a single piece of looped rope. The second example bearing structure 160 comprises first, second, third, fourth, fifth, and sixth ropes 162*a*, 162*b*, 162*c*, 162*d*, 162*e*, and 162*f* defining first, second, third, fourth, fifth, and sixth splice regions 164*a*, 164*b*, 164*c*, 164*d*, 164*e*, and 164*f*. With each loop portion 40 formed by a single length of rope 162, crossing of loop portions 40 is eliminated.

Figure 3D:
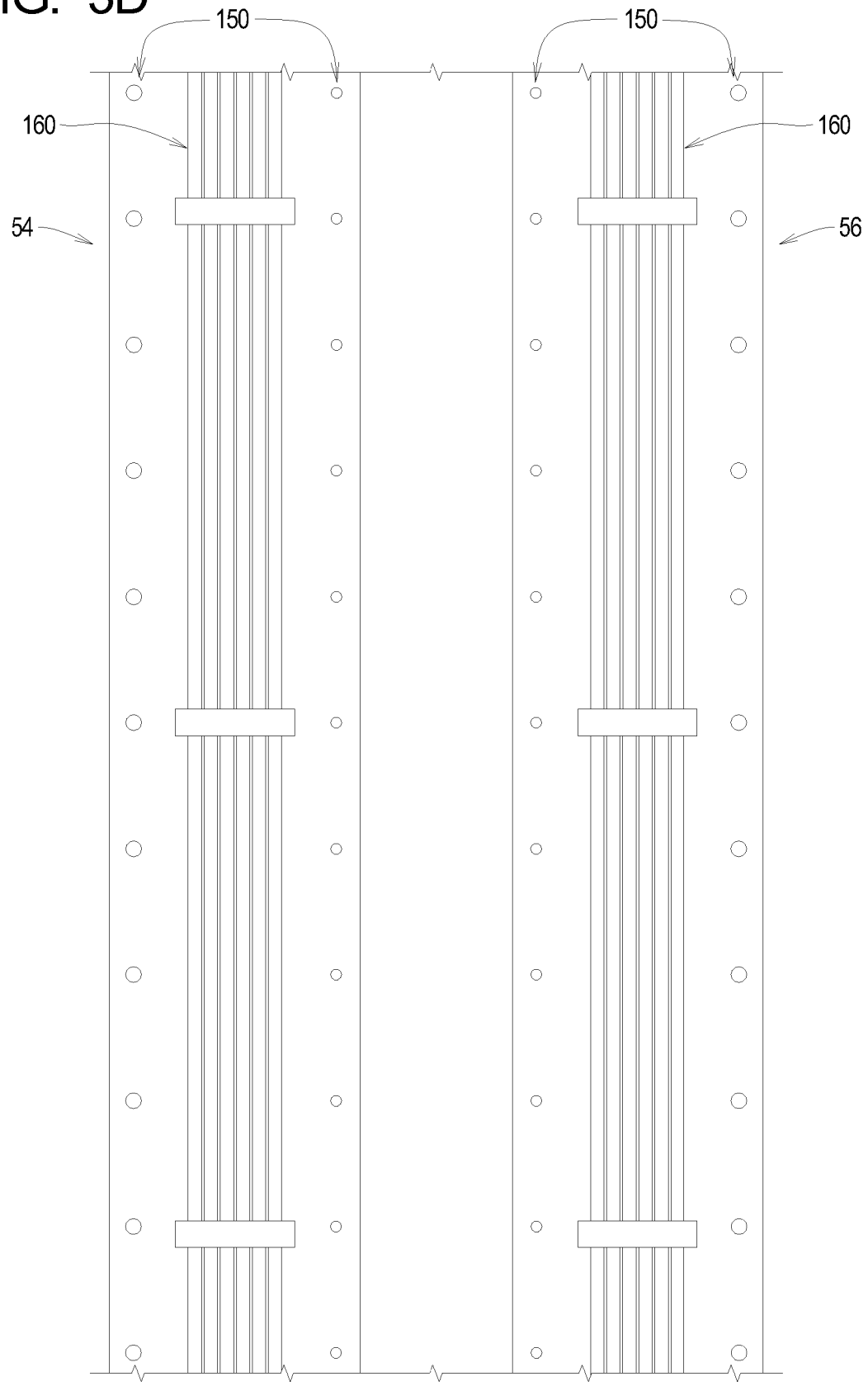
FIG. 3D is a somewhat schematic plan view of a portion of the second example cover member and the second example rope structure that may be used as part of the first example round sling system depicted in FIG. 1.

FIG. 3D illustrates that the second example closure system 150 may be combined with the second example bearing structure 160.

Figure 5A:
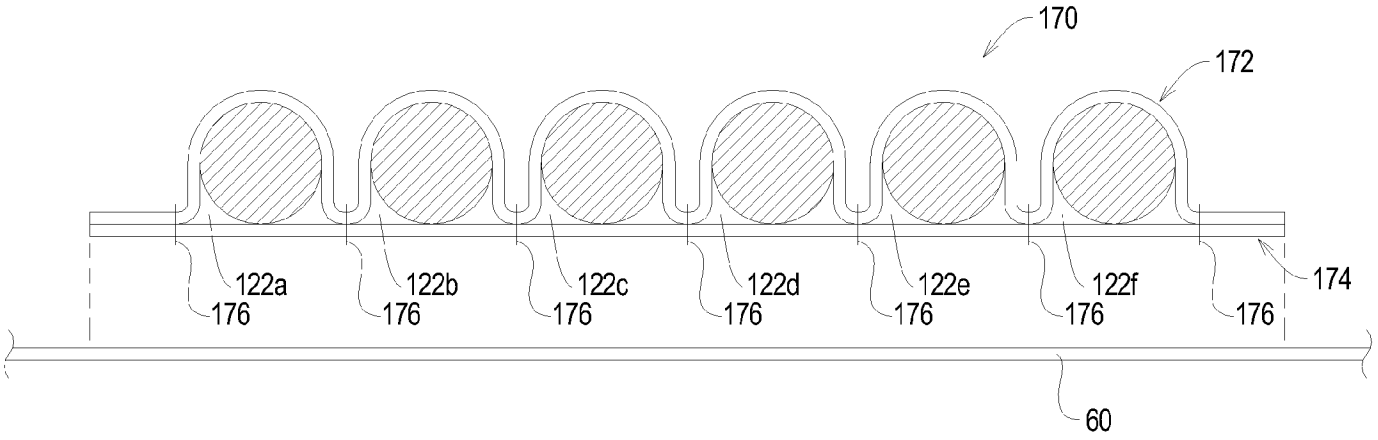
FIGS. 5A and 5B are section views similar to FIGS. 4A and 4B, respectively, depicting the process of forming a second example organizer that may be used as part of the first example round sling system depicted in FIG. 1.
Figure 5B:
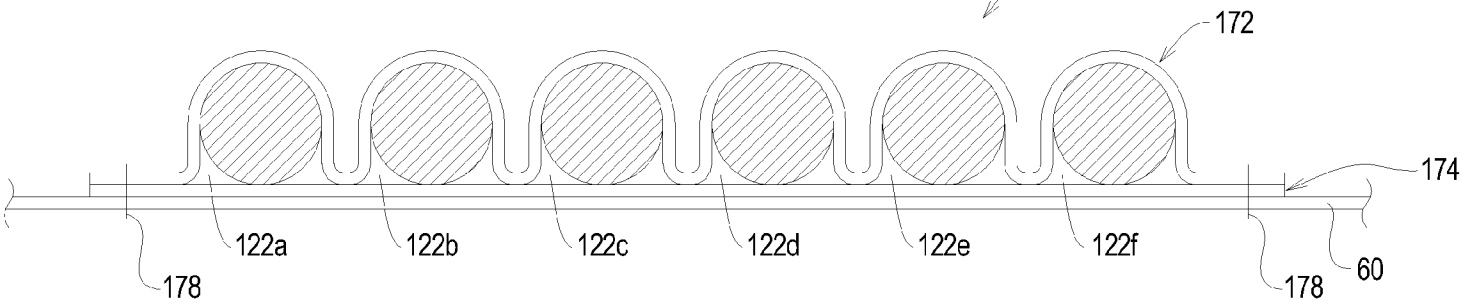

Referring now to FIGS. 5A and 5B of the drawing, depicted therein is a second organizer type 170 that may be used as one or more of the example organizers 80, 82, and 84. The second organizer type 170 comprises a first organizer member 172 secured to a second organizer member 174 to define the organizer openings 122. The example first organizer member 172 is sewn to the second organizer member 174 by threads 176, and the second organizer member 174 is sewn to the cover member 60 by threads 178, but other securing systems and methods such as snap fasteners, adhesives, hook and loop fasteners, or the like may be used to secure the first organizer 172 to the second organizer 174 and/or the second organizer member 174 to the cover member 60.

Figure 6A:
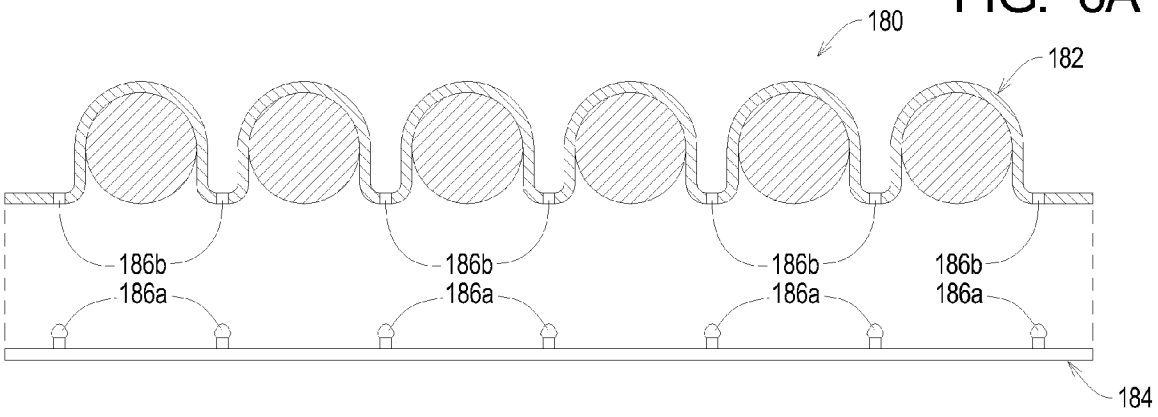
FIGS. 6A and 6B are section views similar to FIGS. 4A and 4B, respectively, depicting the process of forming a third example organizer that may be used as part of the first example round sling system depicted in FIG. 1.
Figure 6B:
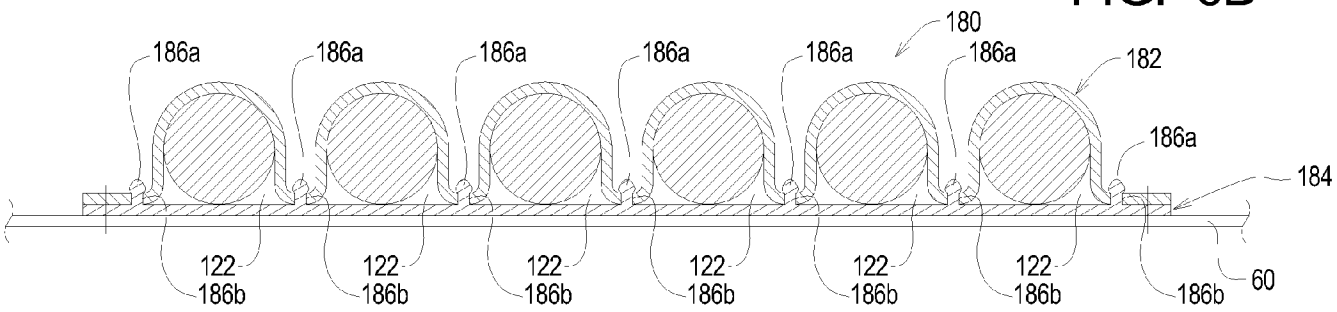

Referring now to FIGS. 6A and 6B of the drawing, depicted therein is a third organizer type 180 that may be used as one or more of the example organizers 80, 82, and 84. The third organizer type 180 comprises a first organizer member 182 secured to a second organizer member 184 to define the organizer openings 122. The example first organizer member 182 is secured to the second organizer member 184 by bayonet members 186*a* that are received by bayonet openings 186*b*. The example second organizer member 184 is sewn to the cover member 60 by threads 188. Alternative securing systems and methods such as snap fasteners, adhesives, hook and loop fasteners, or the like may be used to secure the first organizer 182 to the second organizer 184 and/or the second organizer member 184 to the cover member 60.

II. Second Example Round Sling System

Figure 7:
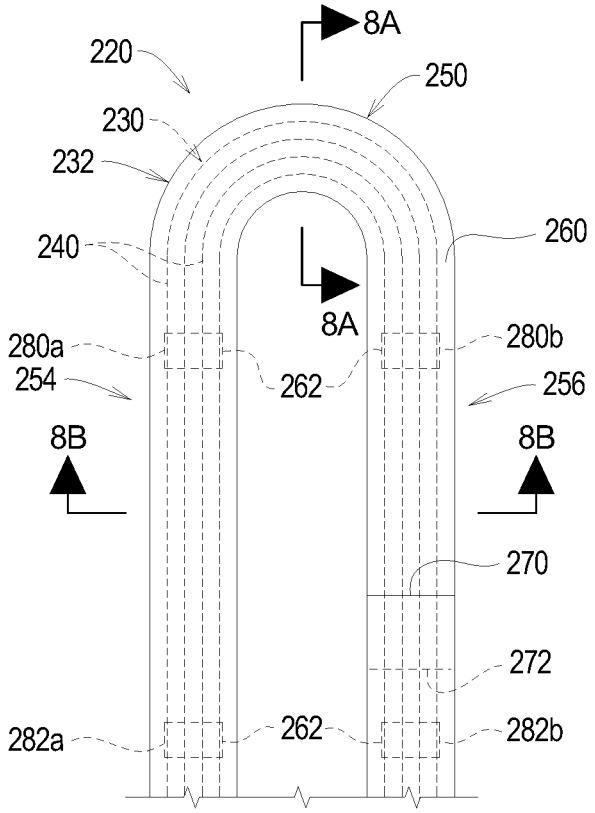
FIG. 7 is a side elevation view of a second example round sling system of the present invention.
Figure 8A:
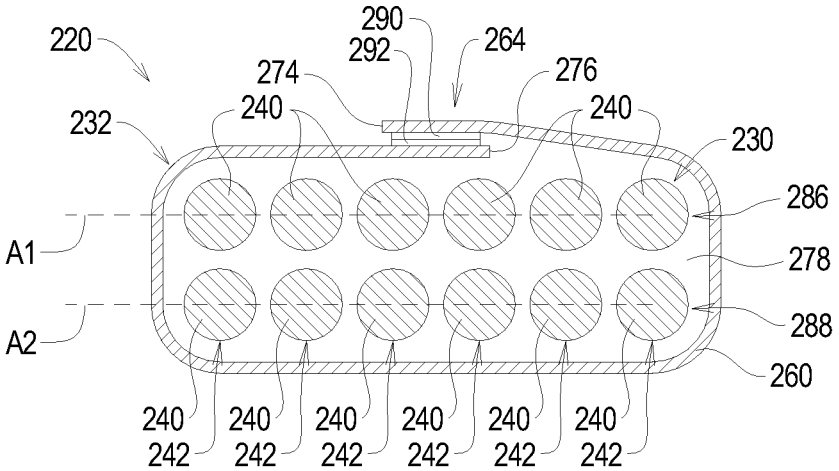
FIG. 8A is a section view taken along lines 8A-8A in FIG. 7.
Figure 8B:
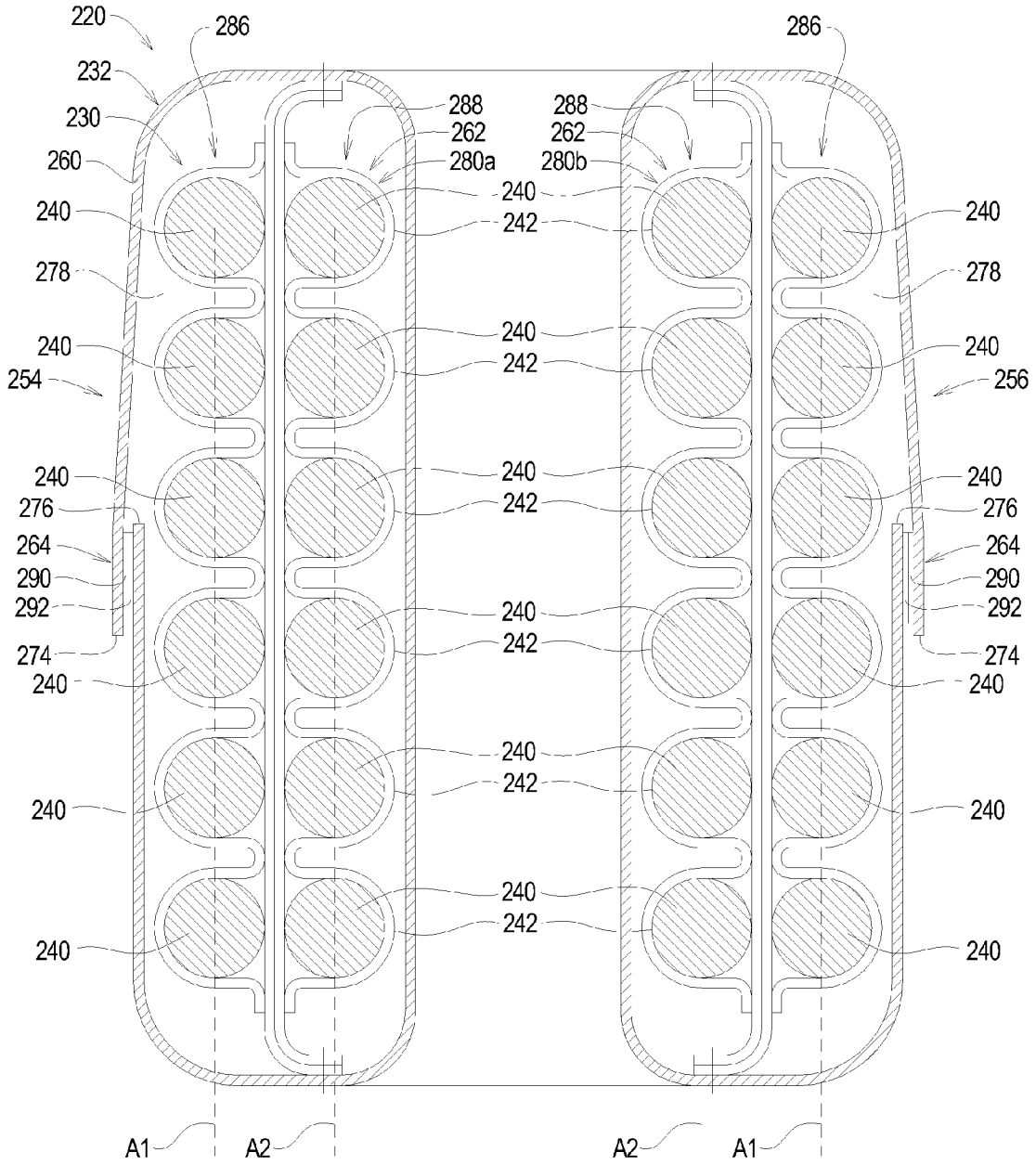
FIG. 8B is a section view taken along lines 8B-8B in FIG. 7.

Referring now to FIGS. 7, 8A, and 8B of the drawing, depicted therein is a second example round sling system 220 constructed in accordance with, and embodying, the principles of the present invention. Like the first example round sling system 20, the second example round sling system 220 is adapted to transfer loads between a first structural member (not shown) and a second structural member (not shown).

The second example round sling system 220 comprises a bearing structure 230 and a cover assembly 232.

The example bearing structure 230 comprises one or more lengths of rope configured to bear the anticipated transfer loads applied to the second example round sling system 220. The example bearing structure 230 comprises a single piece of rope arranged in one or more loops 240 to define a plurality of bearing positions 242. The rope forming the example bearing structure 230 is configured to define 12 loops arranged in twelve bearing positions.

During use of the first example rope sling 220, the bearing structure 230 defines a first end portion 250, a second end portion (not visible in FIG. 7), a first side portion 254, and a second side portion 256 of the first example rope sling 220.

The example cover assembly 232 comprises a cover member 260, an organizer system 262, and a closure system 264.

The example cover member 260 is a flat sheet of flexible material such as fabric defining a first end edge 270, a second end edge 272, a first side edge 274, and a second side edge 276. The example cover member 260 is capable of being folded or wrapped into a toroidal shape by overlapping the first and second end edges 270 and 272 and the first and second side edges 274 and 276. When folded with the end edges 270 and 272 overlapped and the side edges 274 and 276 overlapped, the cover member 260 defines a cover chamber 278. The example cover chamber 278 is substantially toroidal. In use, the substantially toroidal shape of the cover chamber 278 is typically elongated as shown in FIG. 1.

The example organizer system 262 comprises at least one first end organizer 280, at least one second end organizer (not shown), and, optionally, one or more intermediate organizers 282.

The example closure system 264 comprises a first edge connector 290 and a second edge connector 292.

When the second example round sling system 220 is formed, bearing structure 230 is arranged within the cover chamber 278, and the bearing structure 230 and the cover assembly 232 are arranged in an elongate loop as shown in FIG. 1. The elongate loop so formed defines the first end portion 250, the second end portions, and the first and second side portions 254 and 256 of the second example round sling system 220.

The first end organizers 280 are secured to the cover member 260 such that the first end organizers 280 are adjacent to the first end 250, while the second end organizers (not shown) are secured to the cover member 260 such that the second end organizers are adjacent to the second end (not shown). The intermediate organizers 282 are spaced between the first end portion 250 and the second end portion (not shown) and are secured to the first and second side portions 254 and 256. In the second example round sling system 220, the first and second first end organizers 280*a* and 280*b* are arranged at each end of the first end portion 250, while first and second second end organizers are arranged at each end of the second end portion. Further, in the second example round sling system 220, the intermediate organizers 282 are arranged at evenly spaced locations along the first and second side portions 254 and 256.

The organizers 280 and 282 are configured to hold the loops defined by the rope forming the bearing structure 220 in the appropriate bearing positions 242 relative to the cover assembly 232. In particular, the example bearing positions 242 are arranged in a grouping such that the longitudinal axes defining six of the loop portions 240 are substantially parallel to and spaced from each other along a first organizer axis A1 and six of the loop portions 240 are substantially parallel to and spaced from each other along a second organizer axis A2. As shown in FIGS. 8A and 8B, the first and second axes A1 and A2 defined by the first end organizers 280*a* and 280*b* arrange the loop portions 240 in two stacked groups 286 and 288. The end organizers 280*a* and 280*b* maintain these stacked groups 286 and 288 throughout the first end portion 250 to control the transfer of loads from the first structural member to the bearing structure 230.

The organizer axes A1 and A2 are depicted as linear in FIG. 8B, but it should be understood that one or more of the end organizers or intermediate organizers may be made of flexible material, in which case the organizer axes A1 and A2 defined thereby can and likely will be curved to define one or more localized points of inflexion along the organizer axes A1 and A2 during normal operation of the second example round sling system 220. However, as will be explained in further detail below, the end and intermediate organizers 280 and 282, and the cover member 260 to which the organizers 280 and 282 are attached, should have sufficient rigidity to prevent the bearing structure 230 from deforming such that the bearing positions 242 do not completely overlap during normal use of second example round sling system 220.

The example closure system 264 secures the first side edge 274 to the second side edge 276 to hold the cover member 260 in a closed configuration to form the cover chamber 278. The example first and second edge connectors 290 and 292 extend along the entire lengths of the side edges 274 and 276, but alternative connector systems may be arranged only at spaced locations along the side edges 274 and 276 as will be described below. A similar connector (not shown) may be arranged to join the first and second end edges 270 and 272, but simply providing sufficient overlap between the first and second end edges 270 and 272 may effectively hold the cover member 260 in its closed configuration to define the cover chamber 278.

In use, the cover member 260 is held in its closed configuration with the bearing structure 230 within the cover chamber 278. The end and intermediate organizers 280 and 282 are arranged to maintain the bearing structure 230 in a desired relationship with the cover assembly member 260 and also such that the individual loop portions 240 are held within the bearing positions 242.

In particular, the first end organizers 280*a* and 280*b* are close enough to each other and the second end organizers (not shown) are close enough to each other to ensure that longitudinal axes of the loop portions 240 are substantially aligned at the first end portion 250 and second end portion (not shown) for desired engagement with the structural members (not shown), respectively.

Figure 9A:
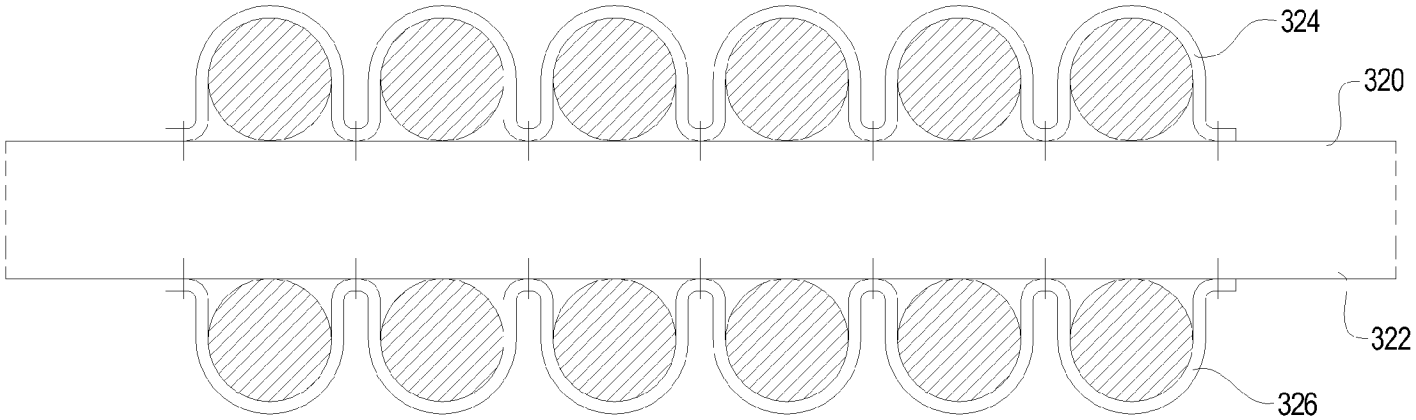
FIGS. 9A and 9B are section views depicting the process of forming a fourth example organizer that may be used as part of the second example round sling system depicted in FIG. 7.
Figure 9B:
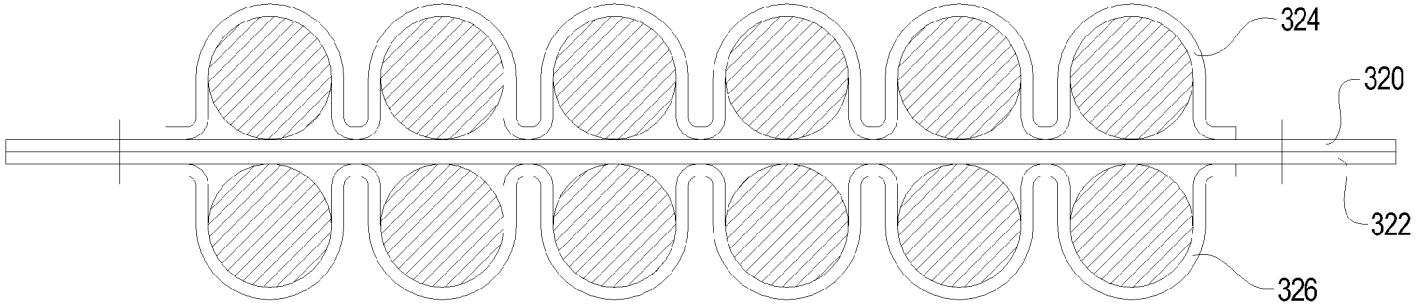

FIGS. 9A and 9B illustrate one example structure of the example organizers 280 and 282 used with the second example round sling system 220. The example organizer structures may be formed by first and second base straps 320 and 322 and first and second loop straps 324 and 326. The first and second loop straps 324 and 226 are sewn to the first and second base straps 320 and 322, respectively. The first and second base straps 320 and 322 are then sewn to the cover member 260. Optionally, the first and second loop straps 324 and 326 may be sewn directly to the cover 260 or to a single base strap that is in turn sewn to the cover. As an alternative to sewing, the loop straps may be secured to the base strap and/or the cover by other securing systems and methods such as hook and loop fasteners, adhesives, snap fasteners, or the like.

III. Terminology

In this written specification, certain reference characters are used both with a suffix and without a suffix. When a given reference character has been used both with and without a suffix, that given reference character is used without a suffix when referring to that component in general, and the given reference character is used with a suffix to distinguish among multiple similar components in a particular example. In this case, the reference character may be used without a suffix in the specification but will not appear in the drawing without a suffix.

The term "longitudinal" refers to the direction of a reference dimension defined by a dimension of a component that is longer than the dimensions of that component in the two directions orthogonal to the reference direction.

The term "parallel" will be used herein to refer to localized longitudinal directions of two components being compared and does not indicate that the two component are parallel along their entire length.

The term "cross" will be used with reference to a particular perspective to refer to one component overlapping or extending over another component.

What is claimed is:

1. A round sling system, comprising:

a bearing structure made of at least one of natural and synthetic fibers and arranged to define a plurality of loop portions and to define at least one bearing structure end portion;

a cover defining a cover chamber;

at least one organizer secured to the cover and configured to engage the bearing structure such that the at least one organizer maintains a position of the bearing structure relative to the cover, and the at least one organizer maintains a spatial relationship of the loop portions at least within the at least one bearing structure end portion; wherein the entire bearing structure is arranged within the cover chamber.

2. A round sling system as recited in claim 1, in which:

the bearing structure defines first and second bearing structure end portions; and one organizer is secured to the cover on each end of each of the first and second bearing structure end portions.

3. A round sling system as recited in claim 1, in which:

the bearing structure defines first and second bearing structure end portions; and a pair of organizers is secured to the cover to engage the bearing structure at each end of each of the first and second bearing structure end portions.

4. A round sling system as recited in claim 1, in which:

the cover member defines first and second cover end edge portions; and the first and second cover end portions overlap at a location spaced from the at least one bearing structure end portion.

5. A round sling system as recited in claim 1, in which:

the cover member defines first and second cover side edge portions and first and second cover end edge portions;

the first and second cover side portions overlap each other; and the first and second cover end portions overlap each other.

6. A round sling system as recited in claim 5, in which the first and second cover end portions overlap at a location spaced from the at least one bearing structure end portion.

7. A round sling system as recited in claim 5, further comprising a securing system configured to secure the first cover side edge portion to the second cover side edge portion.

8. A round sling system as recited in claim 1, in which:

the bearing structure defines first and second bearing structure end portions and first and second bearing structure side portions; and one organizer is secured to the cover at each end of each of the first and second bearing structure side portions.

9. A round sling system as recited in claim 1, in which the cover member is arranged in a toroidal shape.

10. A round sling system as recited in claim 1, further comprising a closure system for securing the cover into a closed configuration.

11. A round sling system adapted to engage first and second structural members, comprising:

a bearing structure made of at least one of natural and synthetic fibers and arranged to define a plurality of loop portions and to define first and second bearing structure end portions and first and second bearing structure side portions;

a cover comprising first and second cover end edge portions and first and second cover side edge portions;

a securing system configuring the cover to define a cover chamber;

a first pair of end organizers secured to the cover;

a second pair of end organizers secured to the cover; and at least one intermediate organizer secured to the cover; wherein the first pair of end organizers are located on the cover to engage the bearing structure adjacent to the first bearing structure end portion;

the second pair of end organizers are located on the cover to engage the bearing structure adjacent to the second bearing structure end portion;

the at least one intermediate organizer engages the bearing structure within at least one of the first and second bearing structure side portions;

the first and second pairs of end organizers maintain a spatial relationship of the loop portions within the first and second bearing structure end portions; and the entire bearing structure is arranged within the cover chamber.

12. A round sling system as recited in claim 11, in which:

the cover comprises first and second cover end edge portions and first and second cover side edge portions;

the securing system secures the first and second cover side portions together such that the first and second side edge portions are not in contact with the first and second structural members, and the first and second end edge portions overlap adjacent to one of the first and second bearing structure side portions.

13. A round sling system as recited in claim 11, in which the cover chamber is substantially toroidal in shape when the securing system configures the cover to define the cover chamber.

14. A round sling system as recited in claim 11, in which the securing system is configured to secure the first cover side edge portion to the second cover side edge portion.

* * * * *